United States Patent [19]

Thatcher

[11] Patent Number: 5,036,667

[45] Date of Patent: Aug. 6, 1991

[54] FLUID POWER ENGINE

[76] Inventor: Eric A. Thatcher, 167 E. 1st Ave., #43, Salt Lake City, Utah 84103

[21] Appl. No.: 521,351

[22] Filed: May 9, 1990

[51] Int. Cl.[5] ..... F02B 71/04

[52] U.S. Cl. ..... 60/595

[58] Field of Search ..... 60/595

[56] References Cited

U.S. PATENT DOCUMENTS

| | | | |
|---|---|---|---|
| 735,863 | 8/1908 | Duryea et al. . | |
| 1,215,383 | 2/1917 | Kenyon . | |
| 1,405,551 | 2/1922 | Nichols . | |
| 1,741,731 | 12/1929 | Nordensson . | |
| 2,178,310 | 10/1939 | Pescara . | |
| 3,170,406 | 2/1965 | Robertson . | |
| 3,283,752 | 11/1966 | Stelzer . | |
| 4,385,597 | 5/1983 | Steizer . | |
| 4,791,786 | 12/1988 | Stuyvenberg | 60/595 |

*Primary Examiner*—Allen M. Ostrager
*Attorney, Agent, or Firm*—Trask, Britt & Rossa

[57] ABSTRACT

A fluid power engine is disclosed. A pair of axially aligned and opposed combustion pistons oscillate in a pair of opposed cylinders. The pistons are connected to each other by a common axial shaft. A fluid power piston is adapted to the shaft and oscillates in a fluid cylinder. Upon oscillating action of the combustion pistons, the fluid power piston oscillates to produce fluid power. By means of a fluid power return assembly, a portion of the fluid power produced is returned to the fluid power piston to urge the combustion pistons in their return directions after their respective firing strokes. The fluid power return assembly includes a spool valve that is actuated by means of physical contact with the combustion pistons.

8 Claims, 3 Drawing Sheets

50
52
20
22
24
26
30
32
34
36
42
44
46
66
68
78
80
82
84

FLUID POWER ENGINE

BACKGROUND OF THE INVENTION

1. Field

The present invention is directed to an engine having a combustion piston linked with a fluid power assembly to pressurize a fluid, a portion of the pressurized fluid being returned to urge the combustion piston in the direction of its return stroke.

2. State of the Art

Internal combustion engines typically have one or more pistons linked with a crankshaft. After ignition of the fuel, energy released from the ignited fuel is delivered to the crankshaft, which rotates in response to the reciprocating motion of the piston. This energy is typically ultimately delivered to a machine that the engine is adapted to power. A common use of internal combustion engines is, of course, their use in automobiles.

Crankshaft-style internal combustion engines in automobiles inherently allow for energy loss at various junctures. For example, energy is lost through friction in the transfer of the reciprocating motion of the piston to rotational motion of the crankshaft. Further energy is lost in transferring the rotational motion of the crankshaft to rotation, for example, of parts within a transmission, differential, and ultimately the wheels of the automobile. The engine is subject to vibration and wear at various locations due to internal forces exerted on various mechanical parts.

One engine design that eliminates a crankshaft is known as the "free piston" engine. Free piston engines typically have two opposed pistons connected by an axial shaft. They are typically two-stroke engines, and are typically used as air compressors.

A problem with free piston engines is that as the work load that the engine is operating against increases, the engine may power down more easily than a crankshaft-style engine. The free piston engine does not have the rotational momentum of a crankshaft to aid in returning the pistons in the direction of their return strokes.

Fluid power systems are recognized as being highly efficient. Once fluid pressure is generated within a system, that pressure is transmitted essentially instantaneously throughout the fluid in the system and is immediately available for work at selected points in the system. Hydraulic systems are particularly useful because of the essential noncompressibility of liquids. When crankshaft-style engines are used to develop fluid power, the reciprocating motion of the combustion piston is transferred to rotational motion of the crankshaft, which is then transferred in some form to a pump to pressurize the selected fluid.

Free pistons have been recognized for their utility in air compressors because the linearly reciprocating motion of the combustion piston may be transferred directly to a linearly reciprocating pumping piston of a compressor piston. However, once a substantial load is placed on the engine in a fluid power system (pneumatic or hydraulic), the power-down problems previously discussed may occur.

There remains a need for an engine adapted to be useful in a fluid power setting that avoids the power-down problems of currently known free piston engines while avoiding the energy losses inherent in a crankshaft-style engine.

SUMMARY OF THE INVENTION

The present invention provides a fluid power engine. A combustion piston is reciprocatingly associated with a combustion cylinder and has a firing direction and a return direction. Carburetion means is associated with the cylinder to introduce fuel into the cylinder. Ignition means is associated with the cylinder to ignite the fuel in the combustion cylinders to thereby urge the combustion piston in its firing direction. Fluid power output means is associated with the combustion piston to pressurize the fluid upon movement of the combustion piston in its firing direction. And a fluid power return assembly is associated with the combustion piston and the fluid power output means and has a directional control valve adapted to direct the pressurized fluid to force the combustion piston toward its return direction.

In a preferred embodiment, the engine comprises two combustion pistons. These combustion pistons are preferably mechanically opposed. In a highly preferred embodiment, the pistons are linked together by means of a common axial shaft.

The directional control valve may be a spool valve, and may be adapted to actuate based upon physical engagement with the combustion pistons. The fluid power return assembly may include a fluid return piston mechanically linked with the combustion pistons to be actuated by the pressurized fluid to force the combustion pistons toward their respective return directions.

Fluid power engines of the invention avoid the inherent energy losses of a crankshaft-style engine. Nevertheless, by means of a direction control valve, a portion of the fluid power energy produced by the internal combustion is returned to force the combustion piston in its return direction, thus helping the engine avoid the power-down problems typically found with free piston engines.

DETAILED DESCRIPTION OF THE ILLUSTRATED EMBODIMENT

Figure 1:
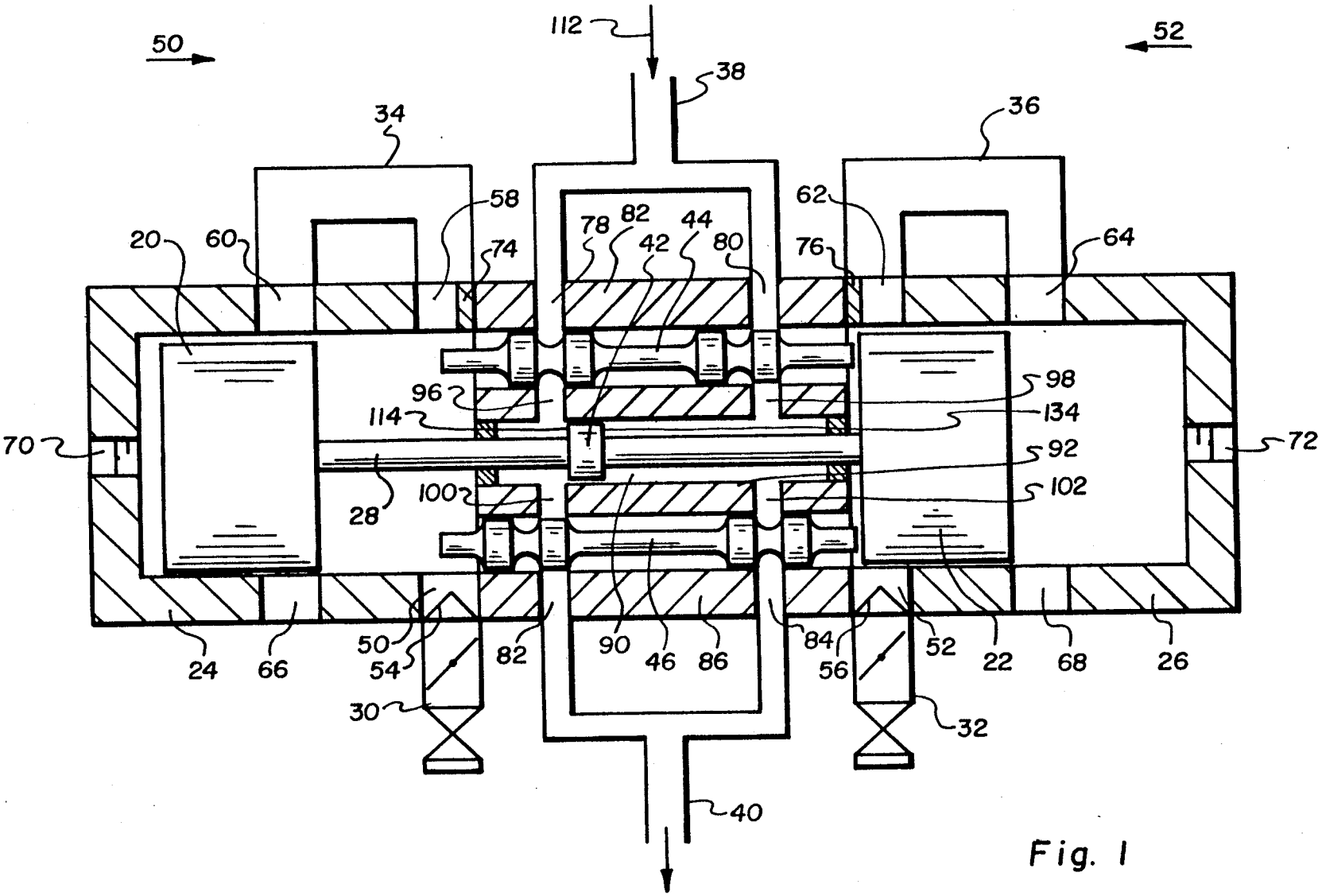
FIG. 1 is a schematic sectional view of a fluid power system of the invention.

Referring to FIG. 1, the illustrated fluid power engine includes a first piston 20, second piston 22, first cylinder 24, second cylinder 26, carburetor 30, carburetor 32, crossover tube 34, crossover tube 36, fluid input tube 38, fluid output tube 40, fluid piston 42, spool valve 44, and spool valve 46.

The engine of FIG. 1 operates in a two-stroke mode, as described more completely below. The carburetion and ignition systems of the disclosed engine are typical of those found on crankshaft-style two-stroke engines, such as those found on motorcycles, snowmobiles, etc. The construction of such engines is well known in the art. Therefore, the carburetion and ignition systems of the engine of FIG. 1 are shown schematically. Although the shown engine is a two-stroke engine, an engine of the invention may also be adapted to be a four-stroke engine. Also, although two positions are shown, an engine may be constructed consistent with the invention to have only one piston operating in a single cylinder.

Carburetor 30 associates with cylinder 24 at a port 50 formed in the wall of cylinder 24. Similarly, carburetor 32 associates with cylinder 26 at a port 52 formed in the wall of cylinder 26. Carburetor 30 includes a reed valve 54 and carburetor 32 includes a reed valve 56. These reed valves preclude gases from reentering the carburetors after the gases have been expelled into cylinders 24 and 26, as described more completely below. Crossover tube 34 associates with cylinder 24 at ports 58 and 60, which are formed in the walls of cylinder 24. Similarly, crossover tube 36 associates with cylinder 26 at ports 62 and 64 formed in the walls of cylinder 26. An exhaust port 66 is formed in the walls of cylinder 24 and an exhaust port 68 is formed in the walls of cylinder 26. A spark plug 70 is attached to cylinder 24 as shown and a spark plug 72 is attached to cylinder 26, as shown.

Fluid input tube 38 is connected to the engine at ports 78 and 80 formed in the engine wall 82, as shown. Similarly, fluid output tube 40 is connected to the engine at ports 82 and 84 formed in wall 86 of the engine.

Fluid piston 42 and piston shaft 28 associate within a cylindrical channel formed in the engine block to form an annular chamber 90 between shaft 28 and cylindrical wall 92 of the engine. Fluid input tube 38 fluidly associates with annular chamber 90 by means of ports 96 and 98 formed in wall 92. Similarly, output tube 40 fluidly associates with annular chamber 90 by means of ports 100 and 102 formed in wall 92, as shown. Because of the action of spool valve 44, only one of ports 96 or 98 is open at any given time. Similarly, because of the action of spool valve 46, only one of ports 82 or 84 is open at any given time.

Spool valve 46 forms an integral part of a fluid power output assembly adapted to direct fluid power produced by the oscillation of pistons 20 and 22 to a fluid power circuit, described below. Spool valve 46 forms an integral part of a fluid power return assembly adapted to return a portion of the fluid power produced to urge the combustion pistons 20 and 22 in their respective return directions.

Both spool valves 44 and 46 are directional control valves. They are not check valves that merely preclude backward motion of fluid, but actuate in response to oscillating motion of the combustion pistons to direct fluid to different parts of the fluid circuit based upon the position of the piston. Rather than being spool valves, either valve 44 or valve 46 may optionally be replaced with another type of directional control valve, such as a rotary valve, a solenoid-actuated valve, a servo valve, or any other type of valve system adapted to control the direction of fluid, based on the position of other mechanical elements.

Cylinders 24 and 26 are preferably formed of cast iron. Pistons 20 and 22 are preferably formed of lightweight aluminum alloy. Other moving elements of the engine such as shaft 28, spool valve 44, and spool valve 46 are formed of hardened steel.

The operation of the engine is now described in reference to FIGS. 1–7. In the position shown in FIGS. 1 and 2, piston 20 has reached the end of its return stroke and piston 22 has reached the end of its firing stroke. Piston 20 is ready to begin its firing stroke and piston 22 is ready to begin its return stroke. The direction of the firing stroke of piston 20 is indicated by arrow 51 and the direction of the firing stroke of piston 22 is indicated by arrow 53. Conversely, the direction of the return stroke of piston 20 is indicated by arrow 53 and the direction of the return stroke of piston 22 is indicated by arrow 51. In other words, the firing and return stroke directions of pistons 20 and 22 are directly opposite.

With piston 20 in its orientation shown in FIG. 1, it covers ports 60 and 66. Piston 22 is in contact with spool valves 44 and 46 and has urged the spool valves into their positions shown in FIG. 1. In this configuration, input tube 38 is fluidly connected to annular chamber 90 by means of ports 78 and 96. Output tube 40 is fluidly connected to annular chamber 90 by means of ports 102 and 84.

In this configuration, inductive sensor 76 senses the close proximity of piston 22 and a signal is given to ignite spark plug 70 to introduce a spark into cylinder 24. This spark ignites the fuel that has been recently introduced into cylinder 24 in a manner that will become clear below to urge piston 20 in its firing direction (arrow 51). A preselected pressure of fluid in tube 38 also acts against surface 114 of piston 42 to aid in urging piston 42 in the direction of arrow 51. A useful such pressure for the liquid pressure in tube 38 has been found to be approximately 1500 pounds per square inch.

Figures 2, 3, 4, 5, 6, 7:
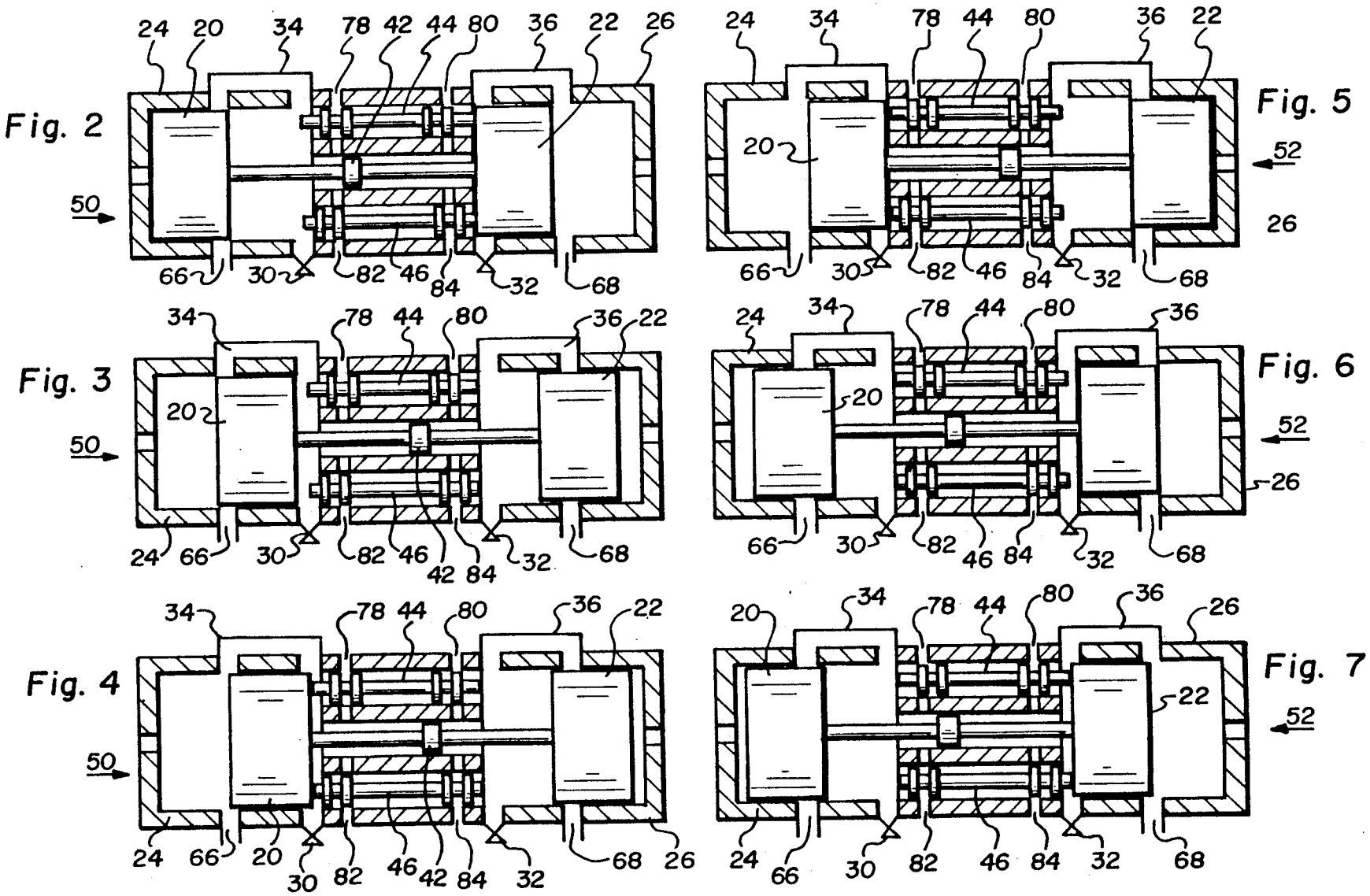
FIG. 2–7 are schematic sectional views of the system of FIG. 1 in various phases of its operation.

With the engine in its configuration shown in FIG. 2, fresh fuel mixture has entered cylinder 24 from carburetor 32. At the same time, fresh fuel mixture that has entered cylinder 26 has been squeezed through crossover tube 36 and into cylinder 26 ahead of piston 22. Spent exhaust fumes are at the same time forced out of cylinder 26 out of exhaust port 68.

Pistons 20 and 22 continue to move in the direction of arrow 51 until they eventually assume the configuration shown in FIG. 3. Fresh fuel mixture is then being compressed by piston 22 in cylinder 26 while fresh fuel mixture enters behind piston 22. Hydraulic liquid in annular chamber 90 is compressed ahead of piston 42 to exit port 84 and tube 40 (FIG. 1). The pressure in tube 40 also preferably maintains a preselected value. A useful value for this pressure is approximately 2500 pounds per square inch.

Pistons 20 and 22 continue to move in the direction of arrow 51 until piston 20 makes initial contact with spool valves 44 and 46, as shown in FIG. 4. At this time, the fresh fuel mixture has mostly been urged into crossover tube 34 and the interior of cylinder 24. Much of the spent exhaust gas has been expelled from cylinder 24. Meanwhile, fresh fuel mixture has entered behind piston 22 to fill cylinder 26 and behind piston 22.

As pistons 20 and 22 continue their movement in the direction of arrow 51, piston 20 urges spool valves 44 and 46 to their configuration shown in FIG. 5. At this time, port 78 is closed while port 80 is opened and port 82 is opened while port 84 is closed. Piston 20 has reached the end of its firing stroke, while piston 22 has reached the end of its return stroke. Inductive sensor 74 (FIG. 1) senses the close proximity of piston 20 and produces a signal to cause spark plug 72 to ignite.

FIGS. 6 and 7 depict the exact reverse of the carburetion and exhaust action as depicted in FIGS. 3 and 4 with the movement of pistons 20 and 22 in the direction of arrow 53, rather than in the direction of arrow 51. At the same time, fluid pressure present at port 80 and port 98 exerts fluid pressure on surface 134 (FIG. I) of piston 42 to aid in urging piston 42 in the direction of arrow 53. Port 82 is connected through spool valve 46 to port 100 so that piston 42 is allowed to pressurize the fluid ahead of its annular chamber 90 to continue to pressurize the fluid in tube 40.

The engine continues to oscillate in this fashion back and forth in the direction of arrows 50 and 52 and act as a pump to pressurize the fluid in tube 40 at a higher pressure than the pressure received at tube 38. The energy used to do work on the hydraulic fluid is gained from the chemical energy released upon combustion of the fuel. The pressure in tube 38 acts somewhat like a crankshaft in helping to return the pistons in the direction of their return strokes.

Figure 8:
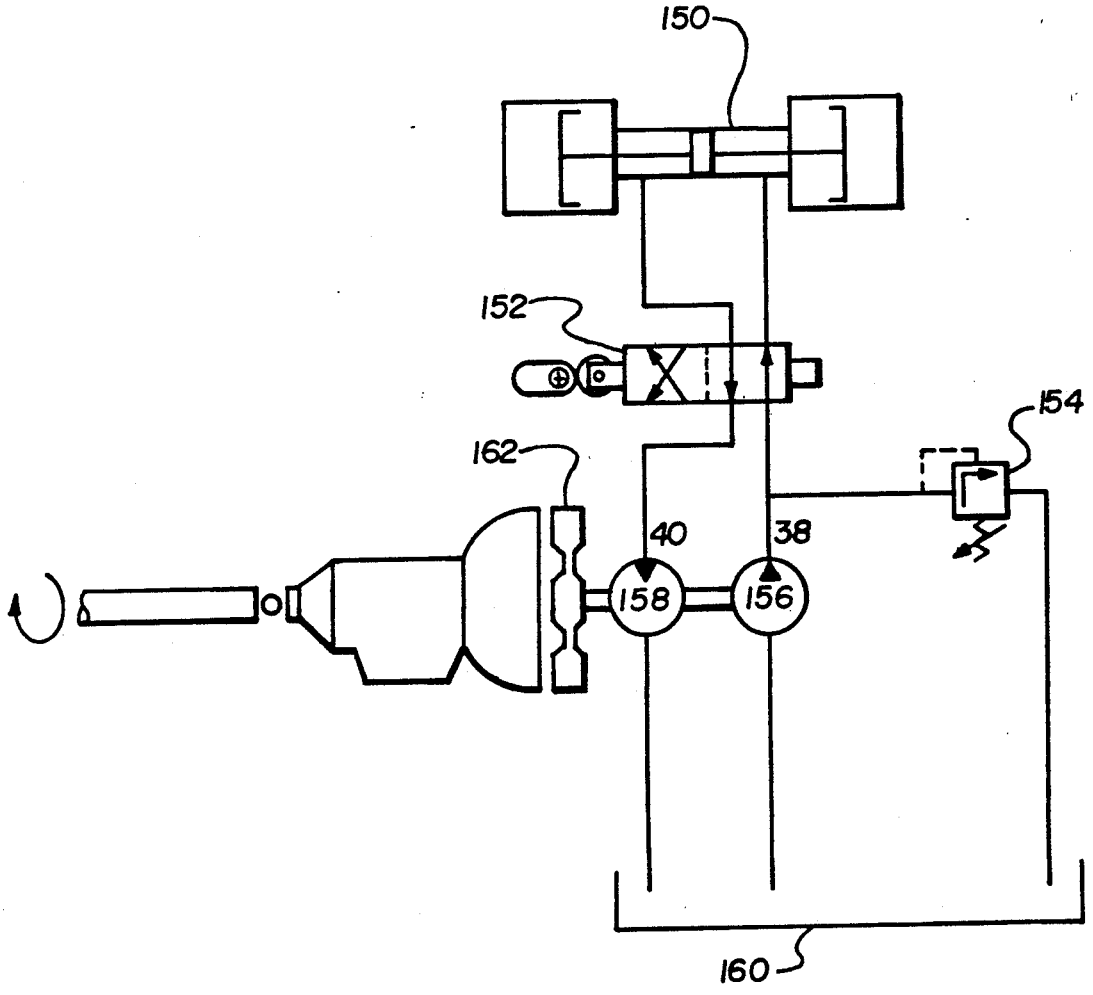
FIG. 8 is a schematic diagram of a fluid power system of the invention.

A description of a fluid power circuit used in conjunction with the engine of FIGS. 1 through 7 is described in reference to FIG. 8. The fluid power system of FIG. 8 includes a fluid piston 150, directional control valve 152, pressure relief valve 154, charge pump 156, hydraulic motor 158, fluid reservoir 160, and flywheel 162.

Fluid piston 150 is constituted by piston 42 operating with annular chamber 90 and the associating ports shown in FIG. 1. Energy to operate pump 156 is obtained from ignition of fuel in the internal combustion engine shown in FIG. 1.

Pump 156 is therefore connected to output tube 40 and to input tube 38, as shown. When the engine of FIG. 1 is not moving, it is necessary to begin motion of the engine in some fashion. Typical internal combustion engines used in automobiles have an electric starter motor that mechanically engages the flywheel to begin rotational motion of the crankshaft and operation of the piston assembly. In the present engine, a charge pump 156 driven by the flywheel 162 forces fluid under pressure into line 38, the pressure in tube 38 is directed through the directional control valve 152 to urge piston 42 (FIG. 1) towards its firing stroke. With each reciprocation of the fluid piston 150, the directional control valve 152 reverses the fluid flow to allow a return stoke. When the intake system finally provides a properly mixed intake charge, ignition takes place and the fluid piston 150 transfers the pressure of combustion to fluid pressure in tube 40. The fluid in tube 40 is forced under pressure through the hydraulic motor 158. At this point, the flywheel 162 is being driven by fluid under pressure in tube 40 through hydraulic motor 158. The fluid in the reservoir is at approximately zero pressure, or zero energy. In a preferred construction, the charge pump 156 raises the fluid pressure to approximately 1500 psi, this charge pressure allows the directional control valve 152 to control mechanical movement of the fluid piston 150. Compression of the air fuel mixture towards the firing stroke absorbs some of the energy in the pressurized fluid supplied by the charge pump 156. The added pressure of the ignited air fuel mixture is imparted to the pressurized fluid and preferably increases the pressure to approximately 6000 psi. The directional control valve 152 diverts the high energy fluid under pressure to the hydraulic motor 158 where the energy of the high pressure fluid is converted to mechanical rotating energy imparted to the flywheel 168, and charge pump 156. The fluid from the hydraulic motor 158 is released to the fluid reservoir at approximately zero pressure and approximately zero energy.

As the directional control valve 152 controls mechanical movement of fluid piston 150, when the engine speed is required to slow, inertia in the flywheel 162 continues to power the charge pump 156, and pressurize fluid in tube 38. This excess fluid energy is relieved by the pressure relief valve 154 and returns the fluid to the reservoir 160.

As shown in FIG. 8, the energy in the flywheel 162 may be used, as is common in most automobiles, to drive a transmission system to propel the drive wheels.

Reference herein to details of the illustrated embodiment is not intended to limit the scope of the appended claims, which themselves recite those features regarded as important to the invention.

What is claimed:

1. A fluid power engine, comprising:

a combustion piston reciprocatingly associated with a combustion cylinder and having a firing direction and a return direction;

carburetion means associated with said combustion cylinder for introducing fuel into said combustion cylinder;

ignition means associated with said cylinder for igniting said fuel in said combustion cylinder to thereby urge said combustion piston in its firing direction;

fluid power output means with an internal fluid and associated with said combustion piston for pressurizing said internal fluid upon movement of said combustion piston in said firing direction; and a fluid power return assembly, associated with said combustion piston and said fluid power output means and having a directional control valve, said fluid power return assembly being adapted to utilize a portion of the energy contained in said pressurized internal fluid to urge said combustion piston toward said return direction, wherein said fluid power output means includes a fluid piston, said directional control valve being adapted to direct a quantity of said internal fluid, pressurized by said fluid power return assembly against said fluid piston, to exert fluid pressure on said fluid piston to urge said combustion piston in its said return direction.

2. A fluid power engine according to claim 1 wherein said fluid piston is mechanically linked with said combustion piston to pressurize said fluid upon movement of said combustion piston in said firing direction.

3. A fluid power engine according to claim 2 wherein said fluid piston and said combustion piston are integrally formed on a common shaft.

4. A fluid power engine, comprising:

a first combustion piston and a second combustion piston mechanically opposed to each other and operating in a pair of combustion cylinders, each said combustion piston having a firing direction and a return direction;

a carburetion system associated with and adapted to induce fuel into said combustion cylinders;

an ignition system associated with said combustion cylinders to ignite said fuel at preselected times to urge said combustion pistons in their respective said firing directions;

a fluid power output assembly with an internal fluid and operably associated with said combustion pistons to pressurize said internal fluid upon movement of said combustion pistons in their respective said firing directions; and a fluid power return assembly associated with said fluid power output assembly and having a directional control valve, said fluid power return assembly being adapted to utilize a portion of the energy contained in said pressurized internal fluid to urge said combustion pistons in their respective said return directions;

wherein said fluid power return assembly includes a fluid piston mechanically linked with said combustion pistons to be actuated by a quantity of internal fluid, pressurized by said fluid power return assembly, and directed against said fluid piston by said directional control valve, said fluid piston operating to urge said combustion pistons in their respective said return directions.

5. A fluid power engine according to claim 5 wherein said directional control valve includes a spool valve reciprocatingly mounted to oscillate between a first position in which it directs fluid pressure to said fluid piston to urge said first combustion piston in its said return direction and a second position in which it directs pressurized fluid to said fluid piston to urge said second combustion piston in its said return direction.

6. A fluid power engine according to claim 5 wherein said spool valve is urged to reciprocate between its said first and second positions by means of a physical engagement with said combustion pistons.

7. A fluid power engine, comprising;

a first combustion piston and a second combustion piston operably associated with a pair of combustion cylinders, said combustion pistons being linked together by means of an axial shaft and each having a firing direction and a return direction;

a carburetion assembly associatively linked with said combustion cylinders to provide fuel to said combustion cylinders;

an ignition assembly associatively linked with said cylinders to ignite said fuel in said cylinders to urge said combustion pistons in their respective said firing directions;

a fluid power output assembly having an internal fluid and a fluid piston mechanically linked with said combustion pistons to displace and pressurize said fluid upon motion of said combustion pistons in their respective said firing directions; and a hydraulic motor having a drive shaft, said hydraulic motor being associated with said fluid power output assembly adapted to receive said pressurized fluid and utilize the energy contained therein to rotate said drive shaft;

a flywheel mounted on said drive shaft;

a charge pump mounted on said drive shaft, said charge pump being adapted to pressurize a quantity of said fluid;

a fluid power return assembly having a directional control valve adapted to direct quantity of fluid pressurized by said charge pump against said fluid piston to urge said combustion pistons in their respective said return directions.

8. A fluid power engine according to claim 7 wherein said fluid piston is mechanically linked with said axial shaft to reciprocate with said axial shaft.

* * * * *